United States Patent [19]

Xtazy de Million-Czarnecki

[11] 4,167,042

[45] Sep. 11, 1979

[54] UNITARY GARMENT

[76] Inventor: Maria Xtazy de Million-Czarnecki, 579 Hawthorne Pl., Chicago, Ill. 60657

[21] Appl. No.: 911,364

[22] Filed: Jun. 1, 1978

[51] Int. Cl.[2] ..... A41D 1/22; A41B 9/00

[52] U.S. Cl. ..... 2/105; 2/114

[58] Field of Search ..... 2/DIG. 7, 74, 114, 243 R, 2/243 A, 243 B, 108, 105, 69, 69.5, 106, 51

[56] References Cited

U.S. PATENT DOCUMENTS

| | | | |
|---|---|---|---|
| 3,078,467 | 2/1963 | Artzt | 2/243 R |
| 3,155,984 | 11/1964 | Derrick | 2/114 |

*Primary Examiner*—Doris L. Troutman

*Attorney, Agent, or Firm*—Dressler, Goldsmith, Clement, Gordon & Shore, Ltd.

[57] ABSTRACT

Unitary garments and a low-cost method of manufacture for such garments are disclosed. The garments of this invention are formed by folding a unitary sheet of material upon itself to form front and back sides. This folded sheet is then cut and seamed to form the garment's shoulders and sleeves.

22 Claims, 12 Drawing Figures

UNITARY GARMENT

BACKGROUND OF THE INVENTION

My present invention relates to unitary garments which are constructed from a unitary piece of material, which require minimal numbers of cuts and seam lines for their fabrication and thus can be manufactured at a relatively low cost.

In my previous invention, U.S. Pat. No. 2,988,746, I disclosed a hooded garment made from a unitary piece of material, preferably plastic, which could be used as a raincoat. However, the fit of the raincoat is quite loose in the arm and shoulder areas due primarily to the cuts which have to be made in order to fabricate the hooded garment.

U.S. Pat. No. 2,144,875 to Forrest discloses a unitary garment which may be worn as either a cape or as a coat. This particular garment requires several cuts and seams as well as a substantial loss of material due to making the cuts. U.S. Pat. No. 3,187,344 to Porcello discloses a garment which also requires several cuts, seams and a considerable loss of material. Furthermore, according to the teachings of this patent, additional pieces in the form of quadrilateral gussets are sewn back into the garment to enhance the fit. Finally, U.S. Pat. No. 2,319,958 to Taylor discloses a sleeping bag for babies made from two separate, juxtaposed pieces of material, that are sewn together whose outside edges are disposed in alignment with the outer edges of the garment. The sleeping bag is provided with sleeves which include sewn-in fastening means associated with the wrist portions of the sleeves, the front slit opening and the neck opening.

SUMMARY OF THE INVENTION

This invention contemplates a garment formed from a single sheet of material which can be folded upon itself to produce front and back panels connected to one another by a longitudinal fold. The front and back panels are cut along curved lines or arcuately, with the cuts extending outwardly toward a longitudinal edge of the folded sheet and also toward a corner of the folded sheet. These arcuate cuts define arm and shoulder covering elements for the garment which are unitary with the rest of the sheet defining a body covering element. The cut edges of the arm and shoulder covering elements are seamed together to define a unitary shoulder and sleeve for the garment. This invention further relates to a low-cost method by which such garments may be manufactured.

The garments of my invention have several desirable attributes. One desirable attribute is that they can be manufactured at a relatively low cost because of their simple design, unitary construction, the few cuts and seams required for their fabrication, and also because the garments can be made with little or no wastage of fabrication material.

Another advantage of the garments of my present invention is that while their design and fabrication can be simple, these garments fit better than other heretofore known garments produced by low-cost fabrication techniques. This better fit is achieved by use of the arcuate cuts which define the arm and shoulder covering elements that ultimately become shoulders and sleeves. These arcuate cuts, and the resultant curving sleeve tops minimize the material in the shoulder regions with attendant reduction in bulkiness and discomfort associated with the excess bulk.

Still another benefit of these garments is that they can be made in relatively few sizes to fit virtually all adults. Likewise, relatively few sizes are needed to fit infants and children of various sizes. Some garments embodying the present invention may be provided with lines of severance in the skirt portion of the garment so that the skirt portion may be shortened from what may be called "dress" length to "shirt or blouse" length.

Yet another advantage of these garments is that they may be worn so that they close in either the front or back. Thus, when worn with a back closure, they resemble smocks and may be used as hospital gowns or painting smocks. If made in small sizes, these garments can be used as bibs for infants. When worn with front closures, these garments resemble dresses.

Numerous other advantages and features of the present invention will become readily apparent from the following detailed description of the invention and the embodiments thereof, from the claims, and from the accompanying drawings.

BRIEF DESCRIPTION OF THE DRAWINGS

In the accompanying drawings forming part of the specification, and in which like numerals are employed to designate like parts throughout the same.

DESCRIPTION OF THE PREFERRED EMBODIMENTS

Figure 1:
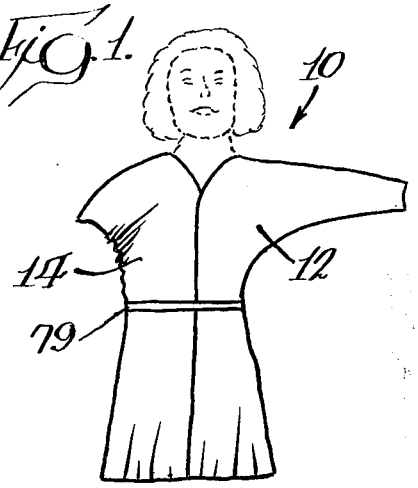
FIG. 1 is a front elevational view showing a front closing embodiment of my invention as it would appear on a wearer.

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

The precise shapes and sizes of the components herein described are not essential to the invention unless otherwise indicated, since the invention is described with only reference to illustrative embodiments.

In the following description, two digit numerals are used to refer to the embodiment illustrated in FIGS. 1 and 2, three digit numerals in the one hundred series are used to refer to the embodiment illustrated in FIGS. 3, 4 and 6, three digit numerals in the two hundred series are used to refer to the embodiment illustrated in FIGS. 5 and 7, and three digit numerals in the three hundred series are used to refer to the embodiment illustrated in FIG. 8. Three digit numerals in the four hundred series are used to refer to the embodiment in FIG. 9, and three digit numerals in the five hundred series are used to refer to the embodiment in FIGS. 10, 11 and 12. The same last two digits in each numeral designate similar or functionally analogous elements in the various embodiments.

For ease of description, the garment of this invention will be described in a normal wearing position as shown in the figures, and terms such as upper, lower, top, bottom, middle, blouse, skirt, waist, longitudinal, etc., will be used with reference to this normal wearing position. It will be understood, however, that the article of this invention may be manufactured, stored, transported and sold in an orientation other than the normal wearing position described.

Figure 2:
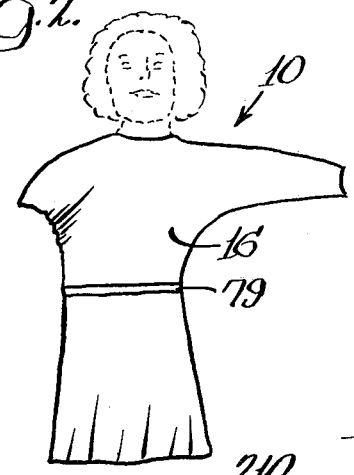
FIG. 2 is a front elevational view of the embodiment shown in FIG. 1 as it would appear on a wearer worn such that it closes at the wearer's back.

The unitary garment of the present invention is illustrated in FIGS. 1 and 2 and is designated therein generally by numeral 10. FIG. 1 illustrates an embodiment worn such that it closes on the front of the wearer's body, while FIG. 2 shows the same embodiment worn such that is closes at the back of the wearer's body.

The unitary garment 10 can have one or two front panels, 12 and 14 (FIG. 1) and a back panel 16 (FIG. 2). Belt 79 secures garment 10 about the wearer. It must be emphasized, however, that in use or manufacture of these garments, these front and back panels may in fact be interchanged, as this garment of this invention may be worn in either manner.

Figure 3:
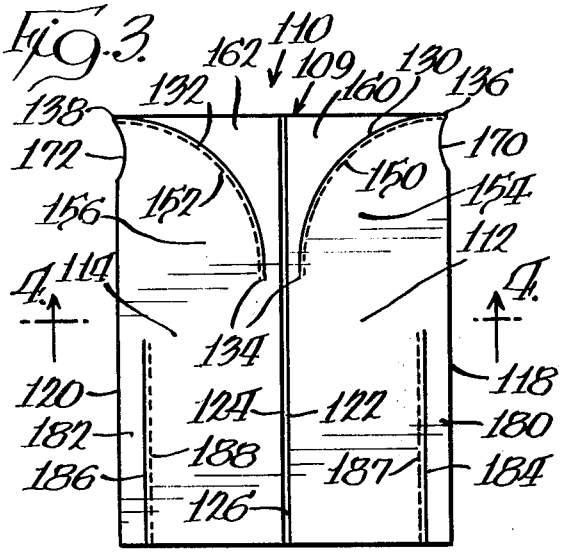
FIG. 3 is a plan view of one embodiment of my invention provided with a belt.
Figure 4:
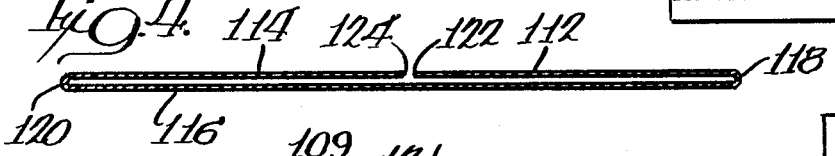
FIG. 4 is a sectional view taken along plane 4—4 of FIG. 3.

The manufacture of a garment such as shown in FIGS. 1 and 2 is illustrated in FIG. 3. A generally rectangular piece of material 109 is first folded upon itself from one end approximately to the middle of the piece of material. In this manner generally rectangular piece of material 109 provides front panels 112 and 114 of the garment both connected to an underlying back panel along longitudinal folds 118 and 120. The relative positions of front panels 112 and 114 and back panel 116 for the garment 110 shown in FIG. 3 are shown in FIG. 4. The longitudinal folds 118 and 120 join or connect panels 112, 114 and 116. Free edges 122 and 124 of the front panels 112 and 114 approximately abut one another in a longitudinal fashion.

The abutting free edges 122 and 124 of the front panels define a longitudinal center line 126 between the panels 112 and 114.

Curved or arcuate cuts 130 and 132 extend from the neck region 134 of the garment to approximately the corners of the panels 136 and 138. These curved or arcuate cuts 130 and 132 define shoulder and arm covering elements which are then seamed together along seams 150 and 152 by stitching, adhesive means, ultrasonic welding, or in any other convenient manner so as to form unitary sleeves 154 and 156 for the garment. Material flaps 160 and 162 formed from the front panels 112 and 114 and the flap formed from the back panel (not shown) when the arcuate cuts 130 and 132 are made may be severed from the garments, or may be used as ties, tucked inside the garment, or otherwise disposed of as desired.

Arm apertures or holes 170 and 172 for the garment are provided by making substantially longitudinal cuts in the sleeves 154 and 156 along longitudinal folds 118 and 120. The cuts extend downwardly from approximately at the corners 136 and 138 for a distance sufficient to provide the desired aperture size. A unitary belt means comprising unitary belt portions 180 and 182 can be formed along the longitudinal folds 118 and 120 by making substantially longitudinal cuts 184 and 186 through front panels 112 and 114 and back panel 116 along lines upwardly spaced from folds 118 and 120. Cuts 184 and 186 extend from about the middle or waist portion of the ultimately produced garment through the lower or skirt portion thereof. The resulting substantially superposed cut edges on the interior of the garment are then seamed together by seams 187 and 188 to further define the lower or skirt portion of this low-cost garment. Seams 187 and 188 may extend all the way to the lower transverse edge of the garment or may terminate at a predetermined distance from the transverse edge.

Figure 6:
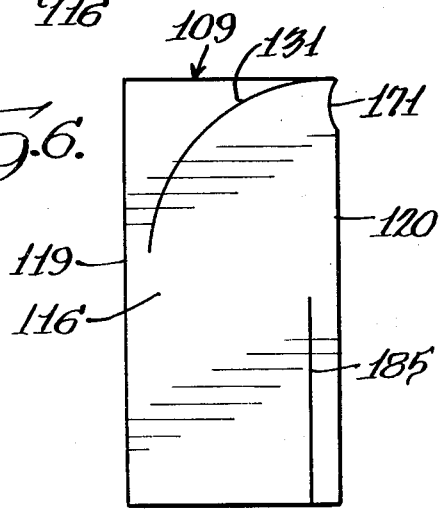
FIG. 6 is a plan view of the embodiment shown in FIG. 3 folded for expeditious cutting during fabrication.

FIG. 6 shows the piece of material 109 as it can be laid out to minimize the number of cutting operations needed for its fabrication and thereby lower the fabrication cost. As illustrated in FIG. 6, the garment may be fabricated from material 109 using only three cuts. To effect such a three-cut fabrication, the piece of material 109 folded as shown in FIG. 3 is further folded over along center line 126 upon itself so that the front panels 112 and 114 are substantially superposed with the longitudinal folds 118 and 120 in substantial registry. The back panel 116 is folded approximately in half and envelops the front panels 112 and 114. This additional folding creates a temporary longitudinal fold 119 which is substantially contiguous with the free edges 122 and 124 of the material. In the configuration of FIG. 6, the arcuate cuts 130 and 132 may be made substantially simultaneously by effecting a single arcuate cut along line 131 through all four thicknesses of the material. The cuts defining the arm holes or apertures 170 and 172 may similarly be made by one cut along line 171 through the four fabric thicknesses. Analogously, the cuts 184 and 186 defining the belt means 180 and 182 may be made by a single cut along line 185 through all four fabric thicknesses.

Figure 5:
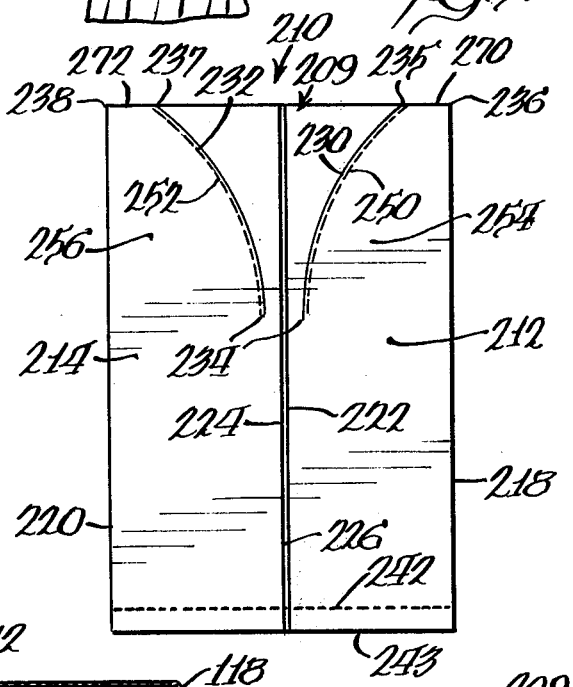
FIG. 5 is a plan view of an embodiment of my invention having a detachable ribbon.

FIG. 5 shows another embodiment of my invention. In this particular embodiment, the front panels 212 and 214 and the back panel 216 (FIG. 7) are joined or connected by folds 218 and 220 in a generally rectangular sheet of material 209 in substantially the same fashion as hereinabove described. The free edges 222 and 224 of the front panels 212 and 214 also approximately abut in a longitudinal fashion to define longitudinal center line 226. The arcuate cuts 230 and 232 define the shoulder and arm covering elements and also extend outwardly from the neck region 234, but intersect the upper edges of the front and back panels at points 235 and 237 away from the corners 236 and 238 of the panels 212, 214 and 216. The arm and shoulder covering elements are then seamed together along seams 250 and 252 to form unitary sleeves 254 and 256 for the garment. The points of intersection 235 and 237 with the upper transverse edge of material 209 are chosen so that when the seams 250 and 252 are made, the material edges extending from the points 235 and 237 outwardly to the panel corners 236 and 238 define arm holes or apertures 270 and 272, respectively, for the unitary garment.

A line of severance 242 is provided near the lower edge or skirt bottom portion of the garment 210 and defines a ribbon 243 which may be removed from the garment either to adjust the length of the garment or to provide belting. This line of severance 242 may, for example, be made by perforating the fabric at spaced intervals. Such perforations may be made before or after the material is folded to form the connected front and back panels 212, 214 and 216, as desired. Additional spaced lines of severance (not shown) can be provided to allow further shortening of the garment so that what once was a dress length garment may be made into a garment of shirt length.

Figure 7:
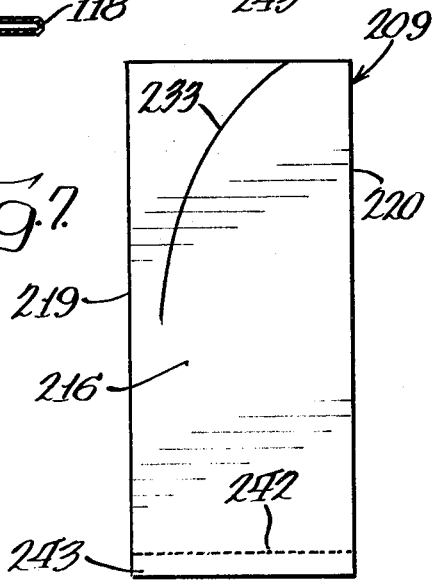
FIG. 7 is a plan view of the embodiment shown in FIG. 5 folded for expeditious cutting during fabrication.

FIG. 7 shows the piece of material 209 as it might be laid out so that it might be fabricated by only one cut through the various panel layers, and the perforations that provide the line of severance. To effect such a fabrication, the sheet of material 209 is formed into panels by folding as hereinabove described in connection with FIG. 6. This folded sheet of material is then further folded over along center line 226 upon itself so that the front panels 212 and 214 are substantially superposed with the longitudinal folds 218 and 220 in substantial registry. The back panel 216 is folded approximately in half and envelops the two front panels 212 and 214. This additional folding creates a temporary longitudinal fold 219 which is substantially contiguous with the free edges 222 and 224 of the material. In the configuration illustrated in FIG. 7, the arcuate cuts 230 and 232 may be made substantially simultaneously by effecting a single arcuate cut along line 233 through all four thicknesses of the material. If the line of severance 242 is to be made after folding, perforation or other act creating such a severance line 242 may be made in one operation by piercing the four thicknesses of material substantially simultaneously at spaced intervals.

It must of course be realized that the folding operations as explained hereinabove in connection with FIGS. 6 and 7 may be carried out such that the back panel 216 (FIG. 7) is folded substantially in half upon itself and then will be located between the front panels 212 and 214 (FIG. 5). When folded in this manner, the front panels 212 and 214 are substantially in register and the longitudinal folds 118 and 120 are superposed. The choice of folding procedures, i.e., back panel enveloping the front panels or back panel between the front panels, is left to the manufacturer. Regardless of which folding procedure is used, the same cuts are used during fabrication.

Figure 8:
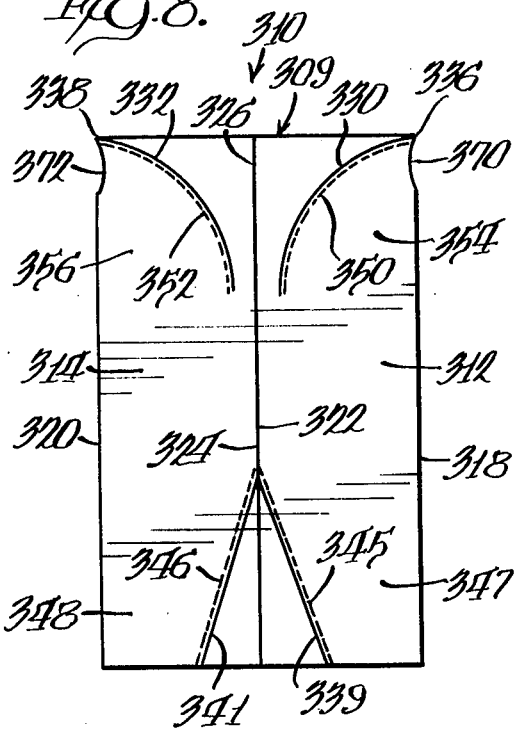
FIG. 8 is a plan view of an embodiment of my invention having pant legs.

FIG. 8 illustrates a unitary garment 310 with pant legs which is commonly referred to as a jumpsuit. The unitary garment 310 illustrated in FIG. 8 has front panels 312 and 314 which are formed from a folded sheet of material 309 in a manner substantially similar to that described hereinabove, and a back panel (not shown) which is connected or joined to the front panels along longitudinal folds 318 and 320. The free edges 322 and 324 of the front panels 312 and 314 also longitudinally abut one another and define longitudinal center line 326. Arcuate cuts 330 and 332 extend from the neck region 334 curving to the corners of the front and back panels 336 and 338 to define unitary arm and shoulder covering elements. Arm holes or apertures 370 and 372 are also defined in this garment by generally longitudinal cuts from the corners 336 and 338 and intersecting the longitudinal folds 318 and 320. The unitary shoulder and arm covering elements are seamed together at seams 350 and 352 so as to define unitary sleeves 354 and 356 for the garment.

Additionally, the garment illustrated in FIG. 8 is provided with cuts 339 and 341 which extend obliquely from the center line 326 outwardly. These oblique cuts 339 and 341 begin at a location below the waist portion of the garment and continue through the bottom of the garment thereby defining leg covering elements. The substantially contiguous edges of the leg covering elements are seamed together at seams 345 and 346 to define unitary pant legs 347 and 348 for the garment.

Figure 9:
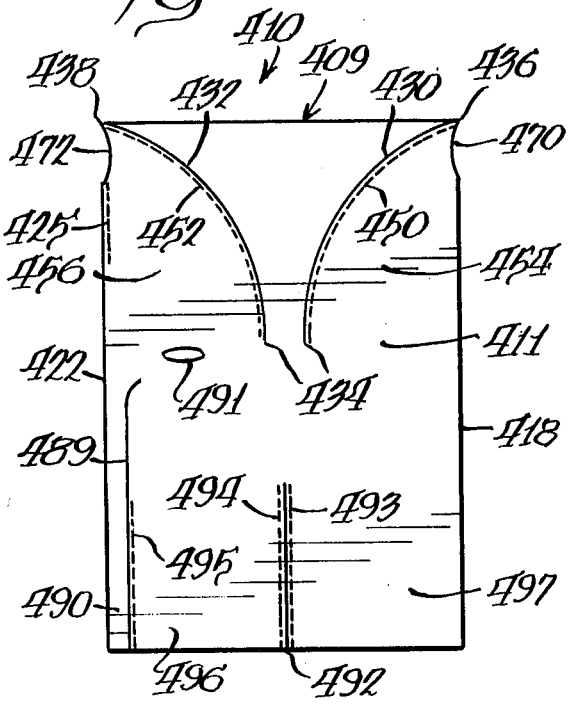
FIG. 9 is a plan view of an embodiment of my invention having pant legs and a belt.

The garment of my invention illustrated in FIG. 9 is designated generally by the numeral 410. In this embodiment there is but one front panel 411 which is substantially coextensive with an underlying back panel having substantially the same configuration. The front panel 411 is connected to the back panel along a longitudinal fold 418 and the free edge 422 of the front panel 411 is substantially contiguous with the free edge of the back panel that underlies front panel 411. Both panels are provided with arcuate cuts 430 and 432 which extend from the neck region 434 of the upper or blouse portion of the garment to the corners of the panels 436 and 438, thereby defining shoulder and arm covering elements for the garment. The cut edges of the arm and shoulder covering elements are seamed together 450 and 452 to define unitary sleeves 454 and 456 for the garment. The free edge 422 of the front panel and the corresponding free edge of the back panel in the upper or blouse portion are seamed together to provide seam 425 which further defines unitary sleeve 456. Arm apertures or holes 470 and 472 are provided by making substantially longitudinal cuts in the sleeves 454 and 456, which cuts extend from approximately at the corners 436 and 438 to intersect the longitudinal fold 418 and the free edge of the front panel 422 and the back panel (not shown). In order to facilitate the putting on of the garment 410, the front panel 411 and the back panel substantially coextensive therewith can be made asymmetric with respect to a line that is an extension of generally longitudinal cut 492. That is, the portion of these panels to the left of cut 492 as seen in FIG. 9 is somewhat larger than the portion to the right of cut 492. By making one panel portion larger than the other, material on the larger, left portion as seen in FIG. 9 may be used as a belt means as described hereinbelow and the finished pant legs also described hereinbelow will be of about the same size.

Folded sheet of material 409 is also provided with a generally longitudinal cut 489 through the front and back panels in the relatively larger panel portions of the aforesaid asymmetric panels. Cut 489 extends upwardly from the lower edge of the garment skirt portion to approximately the garment waist portion and defines a unitary belt means 490. The front and back panels also define a hole or aperture 491 through which the belt means may be threaded. Another generally longitudinal cut 492 extending from the lower skirt edge to below the waist is provided in the garment which cut defines leg covering elements for the garment. The substantially contiguous cut edges of leg covering elements are seamed together 493 and 494 to define pant leg 497 and also to partially define pant leg 496. Seam 495 extends from the lower edge of the skirt to a minor extent toward the waist and joins the substantially contiguous cut edges of the leg covering element produced by the generally longitudinal cut 489, thereby further defining the pant leg 496.

Figure 10:
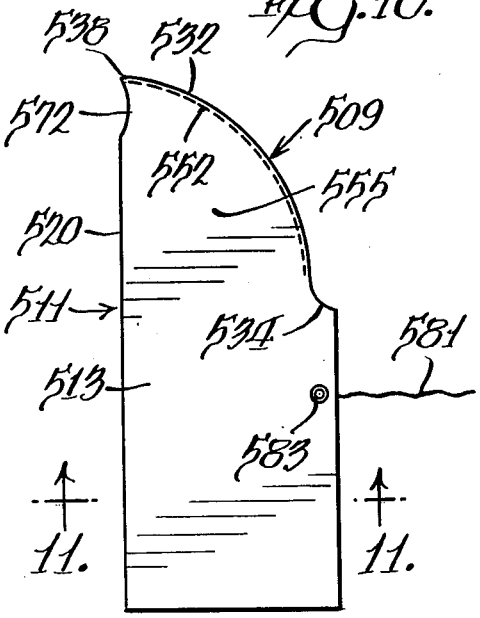
FIG. 10 is a plan view of yet another embodiment of my invention.
Figure 11:
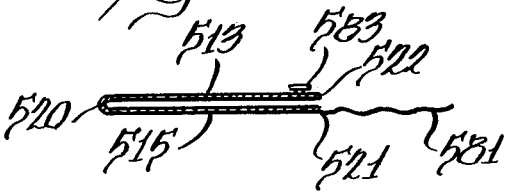
FIG. 11 is a sectional view taken along plane 11—11 of FIG. 10.

In FIG. 10 the sheet of material 509 provides a garment half 511 which can be worn together with an opposite half of a garment made from a similar or dissimilar material. The front panel 513 and back panel 515 (FIG. 11) are unitary, are substantially of the same size, and are joined together along a generally longitudinal fold 520. FIGS. 10 and 11 also illustrate the tie means 581 and anchor means 583 for securing the garment half about a wearer. The free edges of the front and back panels 522 and 521 are also illustrated in FIG. 11.

The sleeve 555 of the garment half 511 produced from the sheet of material 509 is formed as hereinabove described by generating in the garment half 511 an arcuate cut 532 that extends from the neck region 534 toward the corner 538 of the panels and through the material thicknesses of both panels. The cut edges defining a shoulder and arm covering element are then joined together by seam 552 to thereby produce the sleeve 555. The arm hole or aperture 572 is provided by a generally longitudinal cut from approximately the corner of the panels 538 to an intersection with the longitudinal fold 520. As illustrated in FIG. 10, the material flap created by the arcuate cut 532 has been removed in this instance to provide an unencumbered neck region 534.

Figure 12:
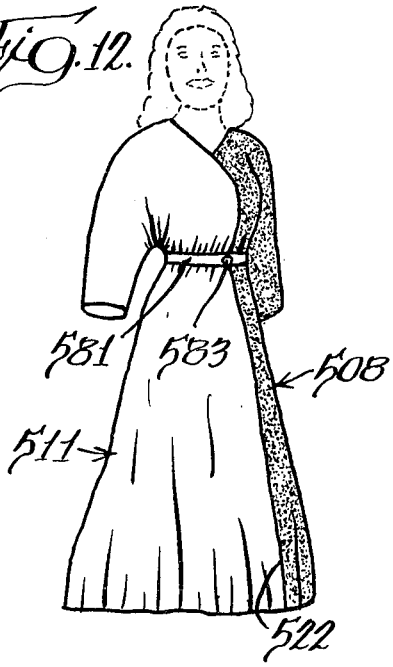
FIG. 12 is a perspective view illustrating the use of the garment shown in FIG. 10.

FIG. 12 illustrates a perspective view of the garment half 511 of FIG. 10 as it may be worn. The stippled region in FIG. 12 illustrates another garment half 508 similar to the garment half of FIG. 10 which may be worn in conjunction with the garment half 511. As illustrated, the stippled garment half 508 is put on first and secured, and the other garment half 511 is put on over it and secured by its belt means 581 and anchor means 583. The free edge 522 of the outer garment half 511 is shown overlapping the inner garment half 508.

Although the embodiments of my invention have been herein described as being made by cuts made substantially simultaneously through two or more panels, my invention also encompasses unitary garments fabricated by cuts made singly, through only one panel thickness.

The products of my invention may be fabricated from many materials depending upon the desired final uses. These materials include, but are not limited to the following: woven or non-woven fabrics, plastics, fabric composites, laminates, and the like.

For high fashion uses, various types of fabrics might be in order. For hospital gowns, for which a one-time use is contemplated, a non-woven fabric product may be useful. For a protective bib, a fabric provided with a non-wetting surface may be desired. As can be seen from the above examples, the fabrication material is limited only by the manufacturer's or user's imagination. The examples given hereinabove are intended to be illustrative only and are not intended to limit my invention in any way.

From the foregoing, it will be observed that numerous variations and modifications may be effected without departing from the spirit and scope of the present invention concept. It is to be understood that no limitation with respect to the specific embodiments illustrated herein is intended or should be inferred.

I claim:

1. A garment comprising a unitary sheet of material forming superposed, unitary front and back panels connected to one another along a longitudinal fold in said sheet;

said front and back panels being provided with substantially contiguous arcuate cuts which extend outwardly toward one end of said panels, curve toward a corner of said panels, and together define an arm and shoulder covering element for said garment between said cuts but unitary with said sheet, and the cut edges of the front and back panels of said arm and shoulder covering elements being seamed together so as to define a unitary shoulder and sleeve for said garment.

2. A garment as defined in claim 1 wherein said front and back panels are provided with substantially contiguous longitudinal cuts adjacent to, but spaced from said longitudinal fold line, said substantially contiguous longitudinal cuts beginning at about the center portion of said garment and extending through the garment edge opposite from said sleeve so as to define a belt means unitary with said garment, and the substantially contiguous longitudinally cut edges of said panels being seamed together so as to define a unitary skirt portion for said garment.

3. A garment as defined in claim 2 wherein panel portions forming said sleeve are provided with substantially contiguous longitudinal cuts near the distal end of the sleeve, which substantially longitudinal cuts intersect the longitudinal fold thereby defining an arm aperture for said sleeve.

4. A garment as defined in claim 3 wherein said garment is substantially symmetrical about a longitudinal center line, and wherein said garment is provided with additional cuts extending away from said longitudinal center line beginning at a location below the waist portion of said garment and toward the corners situated longitudinally opposite said corners toward which said arcuate cuts extend; said additional cuts defining unitary leg covering elements for said garment, and the substantially contiguous cut edges of said leg covering elements being seamed together to define pant legs for said garment.

5. A garment as defined in claim 1 wherein a pair of front panels is connected to a single back panel along the longitudinal edges thereof.

6. A garment as defined in claim 1 wherein said front and back panels near the end of said garment opposite said end toward which said arcuate cuts extend are provided with a line of severance defining a ribbon removable from said garment.

7. A garment as defined in claim 1 wherein panel portions forming said sleeve are provided with substantially contiguous longitudinal cuts near the distal end of the sleeve which substantially longitudinal cuts intersect the longitudinal fold thereby defining an arm aperture for said sleeve.

8. A garment as defined in claim 7 wherein said unitary front and back panels are of substantially the same size and further contain a belt means associated with one said panel and an anchor means associated with the other said panel.

9. A garment formed from a unitary folded sheet of material which is folded upon itself to form superposed panels having a width dimension and length dimension so that adjacent panels are connected to one another along a longitudinal fold in said sheet, said folded sheet of material being provided at one end portion with a pair of outwardly extending, diverging arcuate cuts which define unitary arm and shoulder covering elements for said garment, and the cut edges of said arm and shoulder covering elements being seamed together to define sleeves for said garment.

10. A garment as defined in claim 9 wherein said garment is substantially symmetrical about a longitudinal center line, and wherein said garment is provided with generally longitudinal cuts about said center line, which cuts extend from the edge of said garment opposite said sleeves toward a middle portion of said garment, and the substantially contiguous edges of said leg covering elements being seamed together to define pant legs for said garment.

11. A garment as defined in claim 10 wherein said generally longitudinal cuts about said center line diverge obliquely from said center line.

12. A garment having a blouse portion, a waist portion and a skirt portion all formed from a unitary folded sheet of material which is folded upon itself to form superposed top and bottom panels, which panels are connected to one another along a longitudinal fold in said sheet, said folded sheet of material being provided within said blouse portion with a pair of outwardly extending diverging arcuate cuts which define unitary arm and shoulder covering elements for said garment, and the cut edges of said arm and shoulder covering elements being seamed together so as to define sleeves for said garment.

13. A garment as defined in claim 12 wherein said top and bottom panels are provided with substantially contiguous longitudinal cuts adjacent to, but spaced from said longitudinal fold line, said substantially contiguous cuts beginning at the waist portion and extending through the length of said skirt portion so as to define a belt means unitary with said garment, and the cut edges of said skirt portion being seamed together so as to further define said unitary skirt portion.

14. A garment as defined in claim 12 wherein said top and bottom panels are substantially coextensive, and wherein free panel edges within said blouse portion are seamed together to further define said sleeves.

15. A garment as defined in claim 14 wherein said panels adjacent to the free edges are provided with substantially contiguous longitudinal cuts near said free edges, said cuts extending from said waist portion through said skirt portion, said cuts defining a belt means, and wherein said panels further define an aperture adapted to receive said belt means.

16. A garment as defined in claim 15 wherein the panel edges adjacent to said belt means are seamed together to a minor extent from the end of said skirt portion toward said waist portion, and wherein said skirt portion is further provided with substantially contiguous, generally longitudinal cuts extending from the end of said skirt toward said waist portion, and said superposed, substantially contiguous generally longitudinally cut edges being seamed together to define unitary pant legs.

17. A low-cost method of forming a garment which comprises the steps of:

longitudinally folding a unitary sheet of material upon itself to form unitary top and bottom panels connected to one another along a longitudinal fold;

cutting said top and bottom panels substantially simultaneously along arcuate lines so as to provide cuts extending longitudinally and outwardly toward one edge of one end of said panels and toward one corner of said one end, thereby defining unitary arm and shoulder covering elements for said garment between said cuts but unitary with said sheet; and seaming together the substantially contiguous cut edges of said front and back panels of said arm and shoulder elements so as to define a unitary sleeve for said garment.

18. A low-cost method of forming a garment as recited in claim 17 further comprising the step of:

cutting said corners of said panels toward which said arcuate cuts extend in a generally longitudinal direction intersecting said longitudinal fold, said longitudinal cuts further defining said unitary sleeve.

19. A low-cost method of forming a garment as recited in claim 18 further comprising the steps of:

cutting said panels contiguously and generally longitudinally from the edge longitudinally opposite said unitary sleeve, adjacent to but spaced from said longitudinal fold, substantially to the waist portion of said garment, said generally longitudinal cut defining a belt means; and seaming together the cut edges across from said generally longitudinal cut from said belt means thereby defining a unitary skirt for said garment.

20. A low-cost method of forming a unitary garment which comprises the steps of:

longitudinally folding a unitary sheet of material upon itself along two longitudinal fold lines to form unitary front and back panels connected to one another along said two longitudinal folds;

further longitudinally folding said folded unitary sheet of material upon itself such that said back panel is folded approximately in half, enveloping said front panels which front panels are substantially superposed, thereby producing a unitary folded sheet of material comprised of four thicknesses of the original sheet of material;

cutting said four thicknesses substantially simultaneously from adjacent to said further longitudinal fold along arcuate lines so as to provide cuts extending longitudinally away from said further longitudinal fold, toward a first end of said folded material and toward one corner of said first end, thereby defining arm and shoulder covering elements for said garment; and seaming together the adjacent pairs of front and back panels so as to define unitary sleeves for said garment.

21. A low-cost method of forming a garment as recited in claim 20 further comprising the step of:

making a line of severance near the end of said folded sheet opposite said first end, thereby creating a ribbon detachable from said garment.

22. A low-cost method of forming a unitary garment which comprises the steps of:

longitudinally folding a unitary sheet of material upon itself along two longitudinal fold lines to form unitary front and back panels joined to one another along said two longitudinal folds;

further longitudinally folding said folded unitary sheet of material upon itself such that said front panels are substantially in register and said longitudinally joining folds are substantially superposed with said back panel folded substantially in half upon itself and between said front panels, thereby producing a folded sheet of material comprised of four thicknesses of the original sheet of material;

cutting said four thicknesses of material substantially simultaneously from adjacent to said further longitudinal fold along arcuate lines extending toward one end of said folded material and toward one corner of said one end, so as to provide cuts extending longitudinally away from said further longitudinal fold, thereby defining unitary arm and shoulder covering elements for said garment; and seaming together the adjacent pairs of front and back panels so as to define unitary sleeves for said garment.

* * * * *